US007495374B2

(12) United States Patent
Lo et al.

(10) Patent No.: US 7,495,374 B2
(45) Date of Patent: Feb. 24, 2009

(54) ELECTRON AMPLIFICATION PLATE FOR FIELD EMISSION DISPLAY DEVICE

(75) Inventors: Chi-Tsung Lo, Taipei (TW); Tzung-Han Yang, Taipei (TW); Jeng-Maw Chiou, Hsinchu (TW); Shy-Wen Lai, Hsinchu (TW); Cheng-Feng Lin, Hsinchu (TW); Chao-Hsun Lin, Hsinchu (TW)

(73) Assignees: Tatung Company, Taipei (TW); Industrial Technology Research Institute, Hsinchu (TW)

( * ) Notice: Subject to any disclaimer, the term of this patent is extended or adjusted under 35 U.S.C. 154(b) by 338 days.

(21) Appl. No.: 11/455,761

(22) Filed: Jun. 20, 2006

(65) Prior Publication Data

US 2006/0290252 A1 Dec. 28, 2006

(30) Foreign Application Priority Data

Jun. 24, 2005 (TW) ..... 94121126 A

(51) Int. Cl.
*H01J 29/70* (2006.01)

(52) U.S. Cl. ..... 313/103 CM; 313/105 CM

(58) Field of Classification Search ..... 313/103 CM, 313/105 CM, 103 R, 310, 336, 351
See application file for complete search history.

(56) References Cited

U.S. PATENT DOCUMENTS 6,943,494 B2 * 9/2005 Chiou et al. ..... 313/496

* cited by examiner

*Primary Examiner*—Vip Patel
(74) *Attorney, Agent, or Firm*—Bacon & Thomas, PLLC

(57) ABSTRACT

The present invention provides an electron amplification plate placed between a first substrate and a second substrate of a field emission display device. The electron amplification plate comprises at least two insulating layers for electrical insulation; and at least one conductive electrode layer having plural apertures, wherein the conductive electrode layer is sandwiched between the insulating layers. The surface of the inner wall of the apertures is coated with an electron-amplifying material for multiplying the quantity of electrons as the surface is impacted. The inner wall of each aperture comprises an upper concave wall and a lower concave wall, and the lower concave wall is used for collecting electrons, and the upper concave wall is used for focusing electrons. Thereby, the electron beam emitted from the emitters can be effectively amplified, and color purity of the field emission display device is high.

15 Claims, 2 Drawing Sheets

ELECTRON AMPLIFICATION PLATE FOR FIELD EMISSION DISPLAY DEVICE

BACKGROUND OF THE INVENTION

1. Field of the Invention

The present invention relates to an electron amplification plate and, more particularly, to an electron amplification plate used in a field emission display device.

2. Description of Related Art

Many contemporary apparatuses, such as a computer, a television, a mobile phone, a personal digital assistant, or a vehicle information system, show signals through controlling a display device. Flat panel display devices, such as a liquid crystal display device, an organic light emitting display device, and a field emission display devices are the preferred display devices due to their low weight, small volume, and little effect to people's health. Among these flat panel display devices, the field emission display device (FED) has the advantages of good picture quality, high yield, short response time, easy-coordinating display characteristics, brightness of over 100 ftL, low weight, minimal thickness, large color-temperature range, good operation efficiency, and wide viewing angle. Compared with the field emission display device, the viewing angle, the range of operation temperature, and the response speed of the conventional liquid crystal display device are small. Besides, the field emission display device performs with high brightness even under sunlight because it is provided with a phosphor layer and it emits light without need for an additional back light module. Therefore, the field emission display device is considered to be the display device, which has ability to compete with or replace the liquid crystal display device.

Under a vacuum circumstance lower than $10^{-6}$ torr, the field emission display device can generate electrons from the emitters on the cathode electrode while supplying an electric field. The electrons emitted from the emitters are subsequently attracted by the positive voltage applied to the anode electrode to thereby impact the phosphor powder and illuminate at the same time. It is known that the electric field supplied to the cathode electrode affects a quantity of the electrons emitted from the emitters. In other words, the larger the electric field supply to the cathode electrode, the more electrons are emitted from the emitters. However, the gate electrode disposed around the emitters has a shape of a ring. As a result, the electric field is not uniform because the electric field is formed in the peripheries of the emitters by the difference in voltage between gate electrode and cathode electrode. For this reason, the dispersion of the electrons emitted from the emitters is presented with a ring shape, which results in disproportionate image brightness and decreases the picture quality of the field emission display device.

Therefore, it is desirable to provide an improved field emission display device to mitigate and/or obviate the aforementioned problems.

SUMMARY OF THE INVENTION

The present invention provides an electron amplification plate placed between a first substrate and a second substrate of a field emission display device. The electron amplification plate comprises at least two insulating layers for electrical insulation; and at least one conductive electrode layer having plural apertures, wherein the conductive electrode layer is sandwiched between the insulating layers, the surface of the inner wall of the apertures is coated with an electron-amplifying material for multiplying the quantity of electrons as the surface is impacted, the inner wall of each aperture comprises an upper concave wall and a lower concave wall, and the lower concave wall is used for collecting electrons, and the upper concave wall is used for focusing electrons. Thereby, the electron beam emitted from the emitters can be effectively amplified, and color purity of the field emission display device can be increased because the dispersion of the electrons landing on the phosphor layer is uniform.

The electron-amplifying material used in the electron amplification plate of the present invention is not limited. Preferably, the electron-amplifying material is selected from the group consisting of an Ag—Mg alloy, a Cu—Be alloy, a Cu—Ba alloy, an Au—Ba alloy, an Au—Ca alloy, and a W—Ba—Au alloy, or a group consisting of beryllium oxide, magnesium oxide, calcium oxide, strontium oxide, and barium oxide.

The conductive electrode layer used in the electron amplification plate of the present invention is not limited. Preferably, the conductive electrode layer is a sheet metal having plural apertures or a mesh grid.

The quantity of the conductive electrode layers sandwiched between two insulating layers is not limited. Preferably, one to three conductive electrode layers are sandwiched between each two insulating layers. More preferably, one conductive electrode layer is sandwiched between two insulating layers. The insulating layer used in the electron amplification plate of the present invention is not limited. Preferably, the insulating layer is composed of plural columns or a continuous structure with plural tubes.

In addition, the dimension of the apertures of the conductive electrode layer used in the electron amplification plate of the present invention is not limited. Preferably, the dimension of the upper concave wall and the dimension of the lower concave wall are different to optimize the electron amplification. More preferably, the dimension of the upper concave wall is smaller than that of the lower concave wall. Besides, the shape of the upper concave wall can be asymmetrical, as can the lower concave wall. The shape of the upper concave wall and the lower concave wall of the conductive electrode layer used in the electron amplification plate of the present invention are not limited. Preferably, the upper concave wall and the lower concave wall are concave inclined walls, or flat inclined walls.

The aperture sizes and positions of conductive electrode layer in the present invention are not limited. Preferably, the apertures of different conductive electrode layer are arranged in different sizes and positions to avoid contaminant from anode cathode and phosphor layer accumulating on the emitters or the cathode electrode as such accumulation decreases the lifetime of the field emission display device. More preferably, the dimensions of the apertures of the conductive electrode layers become larger and larger from the first substrate toward the second substrate, and the centers of the apertures of the conductive electrode layers do not on form a line perpendicular to the first substrate, or the combination thereof.

Other objects, advantages, and novel features of the invention will become more apparent from the following detailed description when taken in conjunction with the accompanying drawings.

DETAILED DESCRIPTION OF THE PREFERRED EMBODIMENT

Embodiment 1

Figure 1:
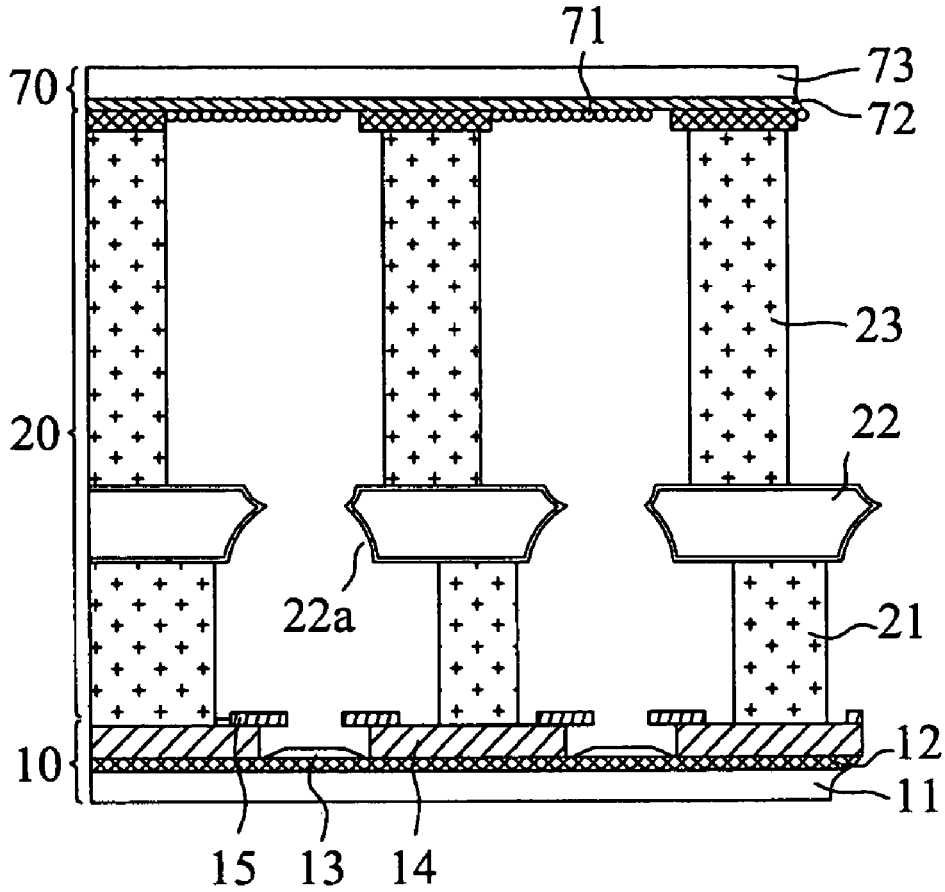
FIG. 1 is a sectional schematic view of the field emission display device according to a preferred embodiment of the present invention.

With reference to FIG. 1, there is shown a sectional schematic view of the field emission display device according to the first embodiment of the present invention. This field emission display device mainly comprises a first substrate 10, a second substrate 70, and an electron amplification plate 20 mounted therebetween.

As shown in FIG. 1, first substrate 10 comprises a bottom substrate 11, a cathode electrode 12, plural emitters 13, a first insulating layer 14, and a gate electrode 15. The cathode electrode 12 is disposed on the bottom substrate 11, and the emitters 13 are disposed on the cathode electrode 12 at appropriate positions. Besides, the emitters 13 are made of electron-emitting material, such as carbon nanotubes for providing the primary emission of electrons in the luminescence mechanism. Therefore, by controlling the voltage applied between the cathode electrode 12 and the gate electrode 15, emitters 13 can emit electrons at a predetermined time.

The second substrate 70 comprises a phosphor layer 71, a black matrix layer 74, an anode electrode 72, and an upper substrate 73. The anode electrode 72 is made of indium tin oxide (ITO) or other transparent conductive materials. The phosphor layer 71 and the black matrix layer 74 are disposed on the lower surface of the anode electrode 72, and the phosphor layer 71 is made of phosphor powders or other phosphor materials. The upper substrate 73 is disposed on upper surface of the anode electrode 72, and the material of upper substrate 73 is glass or other transparent materials.

In the FED structure as in the above, voltages are applied to the gate electrode 15, the cathode electrode 12, and the anode electrode 72 to drive the FED. The electrons are emitted from the emitters 13 and move up to anode electrode 73 by application of voltage potential difference between the cathode electrode 12 and the anode electrode 72, and impact the phosphor layer 71 to provide light for viewing.

Figure 2:
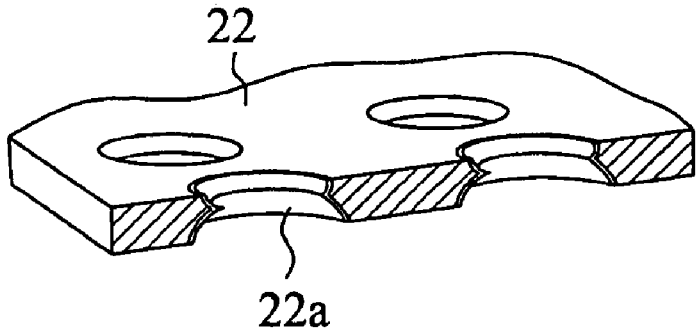
FIG. 2 is a perspective sectional drawing of the conductive electrode layer shown in FIG. 1.

Referring to FIG. 1 and FIG. 2, electron amplification plate 20 is placed between the first substrate 10 and the second substrate 70 to define a space therebetween. The electron amplification plate 20 comprises a second insulating layer 21, a conductive electrode layer 22, and a third insulating layer 23. The second insulating layer 21 is disposed upon the first insulating layer 14 and is composed of plural insulating pillars or a continuous tubular structure for electrical insulation. The conductive electrode layer 22 can be a sheet metal having plural apertures 22*a* or a mesh grid. The surface of the inner wall of the apertures is coated with an electron-amplifying material.

The preferred electron-amplifying material of the aperture 22*a* can be an alloy such as an Ag—Mg alloy, a Cu—Be alloy, a Cu—Ba alloy, an Au—Ba alloy, an Au—Ca alloy, an Ag—Mg alloy, or a W—Ba—Au alloy. Also, an oxide of beryllium, magnesium, calcium, strontium, barium, or other metal oxide with a high amplification factor can be used as the electron-amplifying material.

Figure 4:
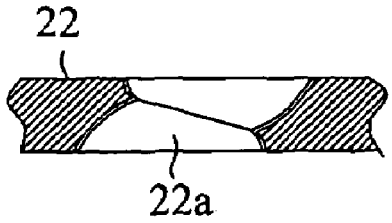
FIG. 4 is a sectional drawing of the conductive electrode layer according to another preferred embodiment of the present invention.
Figure 5:
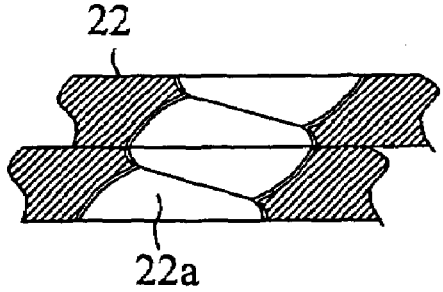
FIG. 5 is a sectional drawing of the conductive electrode layer according to a further preferred embodiment of the present invention.

In this embodiment, the inner wall of each aperture 22*a* comprises an upper concave wall and a lower concave wall, and the dimension of the lower concave wall is larger than that of the upper concave wall as shown in FIG. 2. Otherwise, the wall inside the aperture 22*a* can be of different shapes. For example, the upper concave wall and the lower concave wall of the aperture 22*a* can be both asymmetrical concave walls as shown in FIG. 4. Also, two apertures 22*a* with symmetrical or asymmetrical concave walls can be combined to form an aperture having a complex shape as shown in FIG. 5.

The surface of the inner wall of the aperture 22*a*, which is coated with an electron-amplifying material, is impacted by the primary emission of electrons to generate the secondary emission electrons. Therefore, the shape of the apertures 22*a* must be optimized to avoid the electrons emitted from the emitters 13 passing through apertures 22*a* without impacting the surface of its inner wall, and be optimized to generate an effective electron amplification effect.

In this embodiment, the inner wall of each aperture 22*a* comprises an upper concave wall and a lower concave wall, wherein the lower concave wall is used for collecting electrons, and the upper concave wall is used for focusing electrons. Besides, the dimension of the lower concave wall is larger than that of the upper concave wall as shown in FIG. 1 and FIG. 2. Hence, the aperture 22*a* can collect electrons effectively and prevent cations backflow so as to increase the amplification factor of the electron amplification plate 20.

In this embodiment, the primary emission of electrons emitted from the emitters 13 are effectively collected by the aperture 22*a* and impact the electron-amplifying material coated on aperture 22*a* of the conductive electrode layer 22 to generate the secondary emission of electrons. Then, the secondary emission electrons move upward and impact the phosphor material of the light-emitting layer 71. Finally, the phosphor layer 71 generates visible light which is transmitted through the upper substrate 73 for viewing.

In addition, the electric fields are formed in the peripheries of emitters 13 by the difference in voltage between gate electrode 15 and cathode electrode 12 such that the dispersion of the primary emission of electrons emitted from the emitters 13 are in the shape of donut. However, the primary emissions of electrons impact the apertures 22*a* of the conductive electrode layer 22 on their way to the anode electrode 72. Accordingly, primary emission electrons can be effectively collected and disturbed by the apertures 22*a* of the conductive electrode layer 22 and the secondary emission electrons are generated. Hence, the problem that the dispersion of the electrons emitted from the emitter 13 is not uniform can be eliminated.

Moreover, the second insulating layer 21 and the third insulating layer 23 of the electron amplification plate 20 can be composed of plural insulating pillars or a continuous tubular structure. Accordingly, the electron amplification plate 20 as a whole (the second insulating layer 21, the conductive electrode layer 22, and the third insulating layer 23) is composed of solid materials. Hence, the electron amplification plate 20 has the functions of electron amplification, space support, and improving the strength of the field emission display device.

Furthermore, Owing to the shielding effectiveness of the electron amplification plate 22, the high electric field generated by the second substrate 70 can be isolated from the first substrate 10. Therefore, the circuit of the field emission display device can be operated effectively.

Embodiment 2

Figure 3:
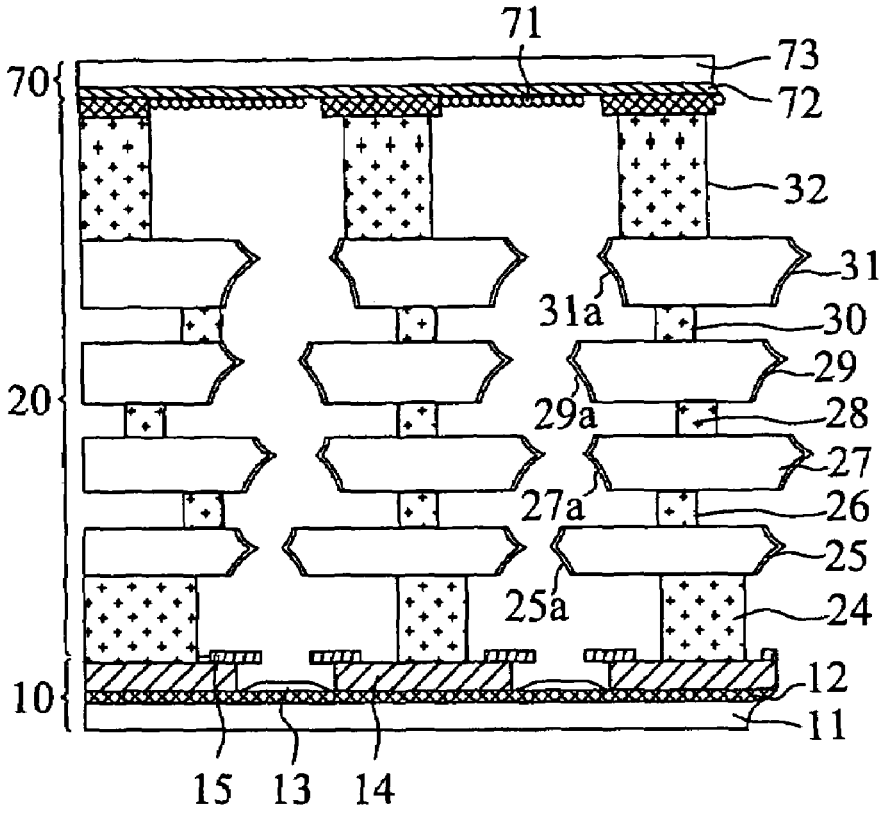
FIG. 3 is a sectional schematic view of the field emission display device according to another preferred embodiment of the present invention.

With reference to FIG. 3, there is shown a sectional schematic view of the field emission display device according to the second embodiment of the present invention. The structure of the field emission display device in this embodiment is similar to that of the FED in the embodiment 1, except for the electron amplification plate 20. In this embodiment, the electron amplification plate 20 is a stack of plural conductive electrode layers and plural insulating layers. The quantity of the electrons emitted from the emitters 13 can be multiplied by these conductive electrode layers for several times. Accordingly, this structure enables the FED to operate while a weak electrical signal is applied.

As shown in FIG. 3, the electron amplification plate 20 comprises a fourth insulating layer 24, a second conductive electrode layer 25, a fifth insulating layer 26, a third conductive electrode layer 27, a sixth insulating layer 28, a fourth conductive electrode layer 29, a seventh insulating layer 30, a fifth conductive electrode layer 31, and an eighth insulating layer 32. Among them, the second conductive electrode layer 25, the third conductive electrode layer 27, the fourth conductive electrode layer 29, and fifth conductive electrode layer 31 are all sheet metals having plural apertures 25*a*, 27*a*, 29*a*, 31*a*. Besides, the surface of the inner wall of each of these apertures 25*a*, 27*a*, 29*a*, 31*a* is coated with electron-amplifying materials.

In this embodiment, the shapes of the apertures 25*a*, 27*a*, 29*a*, 31*a* are similar to the shape of the aperture 22*a* in embodiment 1. As shown in FIG. 3, each of the apertures 25*a*, 27*a*, 29*a*, 31*a* has a lower concave wall for collecting electrons, and an upper concave wall for focusing electrons. Thus, the electrons emitted from emitters 13 can effectively impact the electron-amplifying materials coated on the surface of the apertures 25*a*, 27*a*, 29*a*, 31*a*.

In addition, the sizes and positions of the apertures 25*a*, 27*a*, 29*a* and 31*a* can be arranged to generate an effective electron amplification effect. As shown in FIG. 3, the aperture 31*a* of the fifth conductive electrode layer is largest in size with the aperture 29*a* of the fourth conductive electrode layer 29 being second largest, the aperture 27*a* of the third conductive electrode layer 27 third largest, and the aperture 25*a* of the second conductive electrode layer 25 the smallest. Thus, the backflow of cations can be prevented. Moreover, the centers of the apertures 25*a*, 27*a*, 29*a*, 31*a* corresponding to an emitter 13 are not in a line perpendicular to the first substrate 10, and thereby the accumulation of the contaminant from anode electrode 72 or phosphor layer 71 on the emitters 13 or the gate electrodes 15 can be prevented. Accordingly, the lifetime of the FED can be increased.

The voltage potential applied to two adjacent electrodes makes the primary emission electrons emitted from the emitters 13 move toward the anode electrode 72. When a voltage is applied between the cathode electrode 12 and the gate electrode 15, electrons are emitted from the emitters 13. Then the electrons emitted from emitters 13 (i.e. primary emissions of electrons) are attracted by a positive voltage applied to the second conductive electrode layer 25 to thereby impact the electron-amplifying material on the surface of the aperture 25*a*, and the secondary emission of electrons are generated. Next, the secondary emission electrons are attracted by the positive voltage applied to the third conductive electrode layer 27 to thereby impact the electron-amplifying material on the surface of the aperture 27*a*, and the third emission electrons are generated. Subsequently, the third emission electrons are attracted by the positive voltage applied to the fourth conductive electrode layer 29 to thereby impact the electron-amplifying material on the surface of the aperture 29*a*, and the fourth emission electrons are generated. After that, the fourth emission electrons are attracted by the positive voltage applied to the fifth conductive electrode layer 31 to thereby impact the electron-amplifying material on the surface of the aperture 31*a*, and the fifth emission electrons are generated. Finally, the fifth emission electrons are attracted by the high positive voltage applied to the anode electrode 72 to thereby excite the phosphor layer 71 and provide visible light for viewing.

The electrons emitted from the emitters 13 impact the apertures 25*a* of the second conductive electrode layer 25, the apertures 27*a* of the third conductive electrode layer 27, the apertures 29*a* of the fourth conductive electrode layer 29, and the apertures 31*a* of the fifth conductive electrode layer 31 on their way to the anode electrode 72. Accordingly, the electrons are collected and the pathway of the electrons is disturbed by the apertures 25*a*, 27*a*, 29*a*, 31*a* of the conductive electrode layer 25, 27, 29, 31. Hence, the dispersion of the electrons is very uniform. Moreover, the electron amplification plate 20 is not a structure with a high aspect ratio. Therefore, the electron amplification plate 20, which is manufactured easily and the structure of which is stable, can function as a space-defining support to improve the support strength of the FED.

Although the present invention has been explained in relation to its preferred embodiment, it is to be understood that many other possible modifications and variations can be made without departing from the scope of the invention as hereinafter claimed.

What is claimed is:

1. An electron amplification plate placed between a first substrate and a second substrate of a field emission display device, comprising:

at least two insulating layers; and at least one conductive electrode layer having plural apertures, wherein the conductive electrode layer is sandwiched between the insulating layers, a surface of the inner wall of the apertures is coated with an electron-amplifying material for multiplying the quantity of electrons as the surface is impacted, the inner wall of each aperture has an upper part being an upward concave wall and a lower part being a downward concave wall, and the downward concave wall is used for collecting electrons, and the upward concave wall is used for focusing electrons.

2. The electron amplification plate as claimed in claim 1, wherein the electron-amplifying material is selected from the group consisting of an Ag—Mg alloy, a Cu—Be alloy, a Cu—Ba alloy, an Au—Ba alloy, an Au—Ca alloy, and a W—Ba—Au alloy.

3. The electron amplification plate as claimed in claim 1, wherein the electron-amplifying material is selected from the group consisting of beryllium oxide, magnesium oxide, calcium oxide, strontium oxide, and barium oxide.

4. The electron amplification plate as claimed in claim 1, wherein the conductive electrode layer is sheet metal.

5. The electron amplification plate as claimed in claim 1, wherein each conductive electrode layer is sandwiched between two insulating layers.

6. The electron amplification plate as claimed in claim 1, wherein plural conductive electrode layers are sandwiched between each two of the insulating layers.

7. The electron amplification plate as claimed in claim 1, wherein the dimension of the upward concave wall is larger than that of the downward concave wall.

8. The electron amplification plate as claimed in claim 1, wherein the dimension of the upward concave wall is smaller than that of the downward concave wall.

9. The electron amplification plate as claimed in claim 1, wherein the shape of the upward concave wall is asymmetrical and the shape of the downward concave wall is asymmetrical.

10. The electron amplification plate as claimed in claim 1, wherein the shapes of the upward concave wall and the downward concave wall are concave inclined walls, or flat inclined walls.

11. The electron amplification plate as claimed in claim 1, wherein the dimensions of the apertures of the conductive electrode layers become larger from the first substrate toward the second substrate.

12. The electron amplification plate as claimed in claim 1, wherein the centers of the aperture on conductive electrode layer do not form a line perpendicular to the first substrate.

13. The electron amplification plate as claimed in claim 1, wherein each insulating layer is composed of plural columns.

14. The electron amplification plate as claimed in claim 1, wherein the insulating layer is composed of a continuous structure with plural tubes.

15. An electron amplification plate placed between a first substrate and a second substrate of a field emission display device, comprising:

at least two insulating layers; and at least one conductive electrode layer having plural apertures, wherein the conductive electrode layer is sandwiched between the insulating layers, a surface of the inner wall of the apertures is coated with an electron-amplifying material for multiplying the quantity of electrons as the surface is impacted, the inner wall of each aperture has a whole upper part being an upward concave wall and a whole lower part being a downward concave wall, and the downward concave wall is used for collecting electrons, and the upward concave wall is used for focusing electrons.

* * * * *